United States Patent [19]

Laauwe

[11] 4,415,122

[45] Nov. 15, 1983

[54] RIGHT-ANGLE SPRAY NOZZLE

[75] Inventor: Robert H. Laauwe, Franklin Lakes, N.J.

[73] Assignee: Essex Chemical Corporation, Clifton, N.J.

[21] Appl. No.: 283,335

[22] Filed: Jul. 14, 1981

[51] Int. Cl.[3] ..... B65D 1/32

[52] U.S. Cl. ..... 239/327; 239/403; 239/434

[58] Field of Search ..... 222/211, 215; 239/327, 239/403, 405, 426, 434

[56] References Cited

U.S. PATENT DOCUMENTS

| | | | |
|---|---|---|---|
| 1,716,525 | 6/1929 | Leong | 239/327 |
| 3,032,276 | 5/1962 | Brainard | 239/327 |
| 3,255,934 | 6/1966 | Leonard | 222/211 |

FOREIGN PATENT DOCUMENTS

| | | | |
|---|---|---|---|
| 1051844 | 1/1954 | France | 239/426 |

*Primary Examiner*—Andres Kashnikow

*Attorney, Agent, or Firm*—Kenyon & Kenyon

[57] ABSTRACT

A right-angle spray-nozzle for a squeeze bottle is in the form of a one-piece body and utilizes only one velocity-increasing orifice, thereby avoiding the undesirably slow venting associated with a squeeze bottle having a high velocity jet of liquid that intersects with a second high velocity jet of air.

1 Claim, 7 Drawing Figures

Fig. 4.
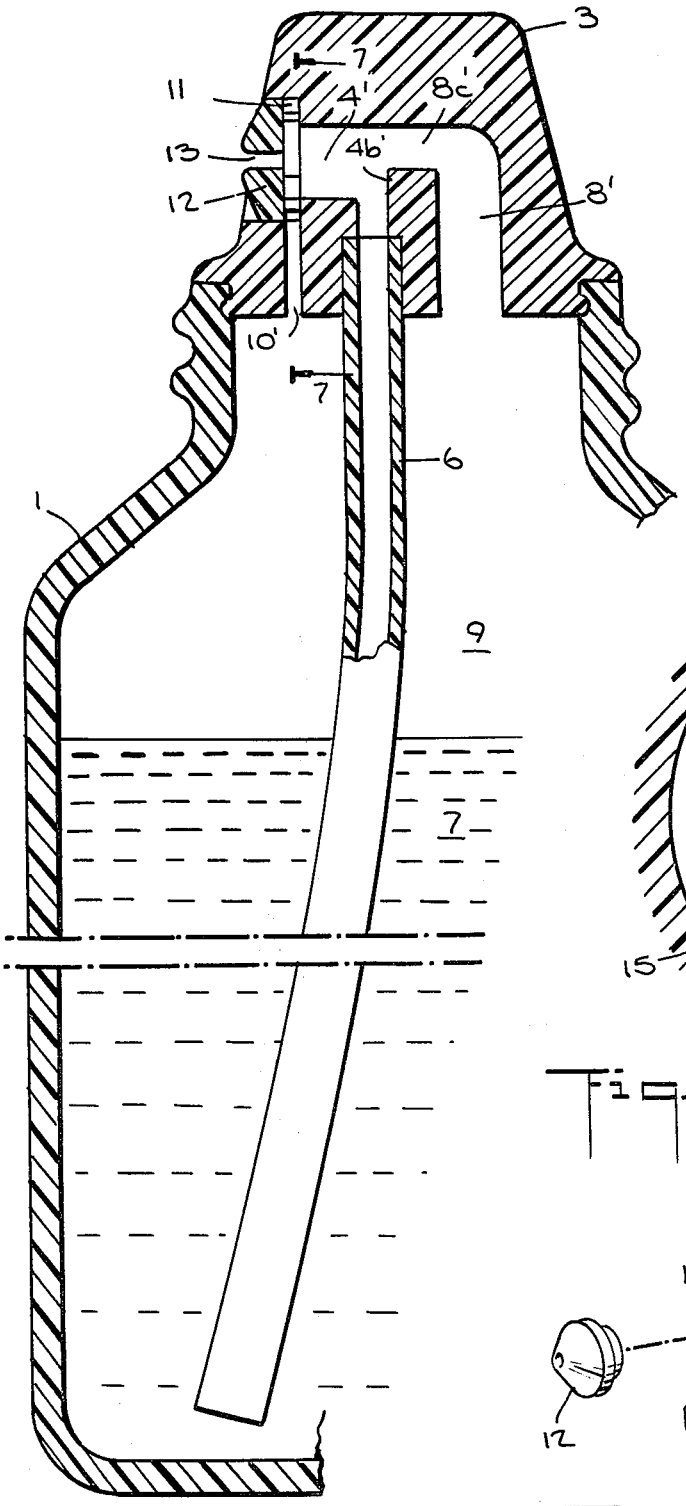
Fig. 6.
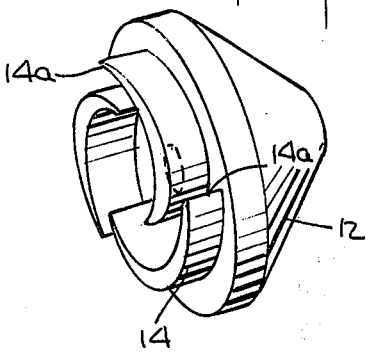
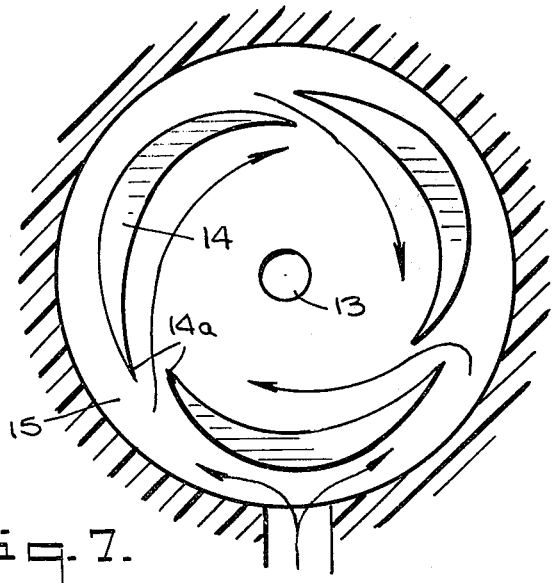
Fig. 7.
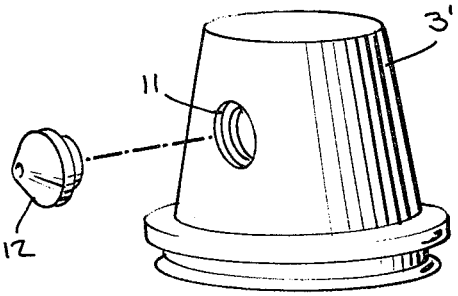
Fig. 5.

RIGHT-ANGLE SPRAY NOZZLE

BACKGROUND

A right-angle spray-nozzle for a squeeze bottle and producing a spray at least approaching the character obtained by the nozzle of the Laauwe U.S. Pat. No. 4,157,789 but made as a one-piece unit, is desirable because of its lower manufacturing cost. This patented nozzle produces an aerosol type spray when a squeezed squeeze bottle contains a liquid product with the usual head space containing air above the product, but this nozzle is of multi-part construction.

The Leong U.S. Pat. No. 1,716,525 discloses an essentially one-piece nozzle that relies on two right-angularly directed high-velocity jets respectively of the liquid and air. To produce these jets requires abnormal bottle squeezing force. Bottle venting after squeezing is slowed undesirably. The jets can be produced only by flow-restricting orifices of which two are required.

This Leong patent nozzle operates on the shear action obtained by one jet driving through the other. Prior art attempts to rely on shear action have not been too successful. An elaborate example of a nozzle relying on shear is the nozzle of the Shay et al U.S. Pat. No. 4,020,979, but which is of multi-part design.

One object of the present invention is to provide a one-piece right-angle spray-nozzle adapted for use on a squeeze bottle containing a liquid product and which produces a spray approaching the character of that obtainable by the Laauwe patent nozzle, while requiring less finger squeezing force and providing faster bottle venting than does the Leong patent nozzle.

SUMMARY OF THE INVENTION

The above object is attained by making the nozzle in the form of a one-piece body internally formed with a transverse first passage having a front end opening through the body's side, and a longitudinal second passage having a bottom end opening from the bottom of the body, and a top end inside of the body and opening into the first passage. This first passage overlaps the top end of the second passage and has a back end adjacently or right behind the second passage's top end. This second passage can be connected via a dip tube with the liquid product in a squeeze-bottle to which the nozzle is applied.

For spray formation the body has a longitudinal third passage having a bottom end opening into the air space always above the liquid in a squeeze-bottle, and this third passage opens into the first passage's back end via a bend and a velocity-increasing orifice, forwardly into the first passage.

When applied to a squeeze-bottle containing liquid and the characteristic head or air space, squeezing of the bottle causes the liquid product to rise via the second passage into the first passage while relatively high velocity air is ejected forwardly via the velocity-increasing orifice supplied with air via the third passage.

The above cannot alone provide the desired spray. Working in this direction the Leong patent suggests that the second passage should also be provided with a velocity-increasing orifice so that a high velocity jet of the liquid is intersected by the high velocity air jet obtained via the third passage. The requirement for these two high velocity jets makes a squeeze-bottle require undesirably forceable finger squeezing and slows venting after squeezing.

The present invention has overcome the above objections by making the longitudinal second passage, which carries the liquid, open into the back end of the first passage without the Leong patent velocity-increasing restriction which inherently provides back pressure. With the second passage opening without restriction into the back end of the first passage, a solid column of liquid rises in the second passage with an exposed top surface in the back end of the first passage through which the spray discharge must flow. Together with this, the third passage carrying the air and which opens into the first passage's back end via the velocity-increasing orifice pointing axially forwardly into the first passage, by this invention is positioned at a level spaced above the top end of the second passage.

The above achieves the unique effect that the top of the solid column of liquid rising into the first passage has its top surface constantly sheared or skimmed off by a high-velocity air jet. The result is surprisingly that with the high-velocity air jet skimming over the top of the solid liquid column, an extremely fine spray is produced which discharges through the front end of the first passage which is of course in a right-angular or horizontal direction when the bottle is held upright. At the same time, the required bottle squeezing force is adequately low for public acceptance, because there is no restriction of the flow of the liquid product. The air jet required to skim over the top of the liquid does not require great pressure because of the very low vescosity of air as compared to that of the liquid product. Venting is rapid because there is no restriction to air-flow backwardly through the second passage.

DESCRIPTION OF THE INVENTION

The accompanying drawing are for use in connection with the following detailed description of the invention, the various views being as follows;

FIG. 4 is like FIG. 2 but shows a modification illustrating how without excessive cost increase the new nozzle can be provided with a swirl chamber fittment;

FIG. 5 is an exploded perspective view of the above modification of the nozzle;

FIG. 6 is a perspective view showing the back or inner end of the fittment; and FIG. 7 is a cross section taken on the line 7—7 in FIG. 4.

DETAILED DESCRIPTION OF THE INVENTION

Figure 1:
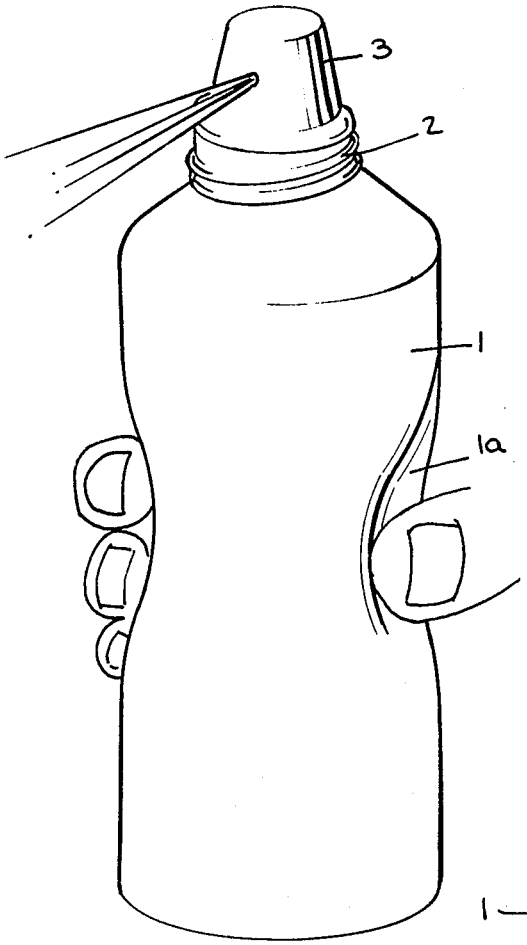
FIG. 1 is a perspective view of a squeeze-bottle provided with the new nozzle and with the bottle being finger squeezed to produce the right-angular or horizontal spray.

In the above drawings FIG. 1 shows a squeeze-bottle 1 of the standard cylindrical type having an externally threaded mouth piece 2 and with fingers squeezing the bottle. The finger squeezing inwardly displaces relatively large areas 1*a* of the bottles side wall so the effective piston area is very large as compared to that of the finger actuated mechanical pump type of spray dispenser used for rigid containers. Because of this large piston area the maximum internal pressure that can be created in a squeeze-bottle by finger squeezing, is in the area of only 5 psi, insofar as the general public is concerned.

The new nozzle 3 is in the form of a one-piece integral body or so-called plug, injection molded by one injection machine shot using conventional die cavity and core tool design. The plug's outside contour depends on artistic preference.

Figure 2:
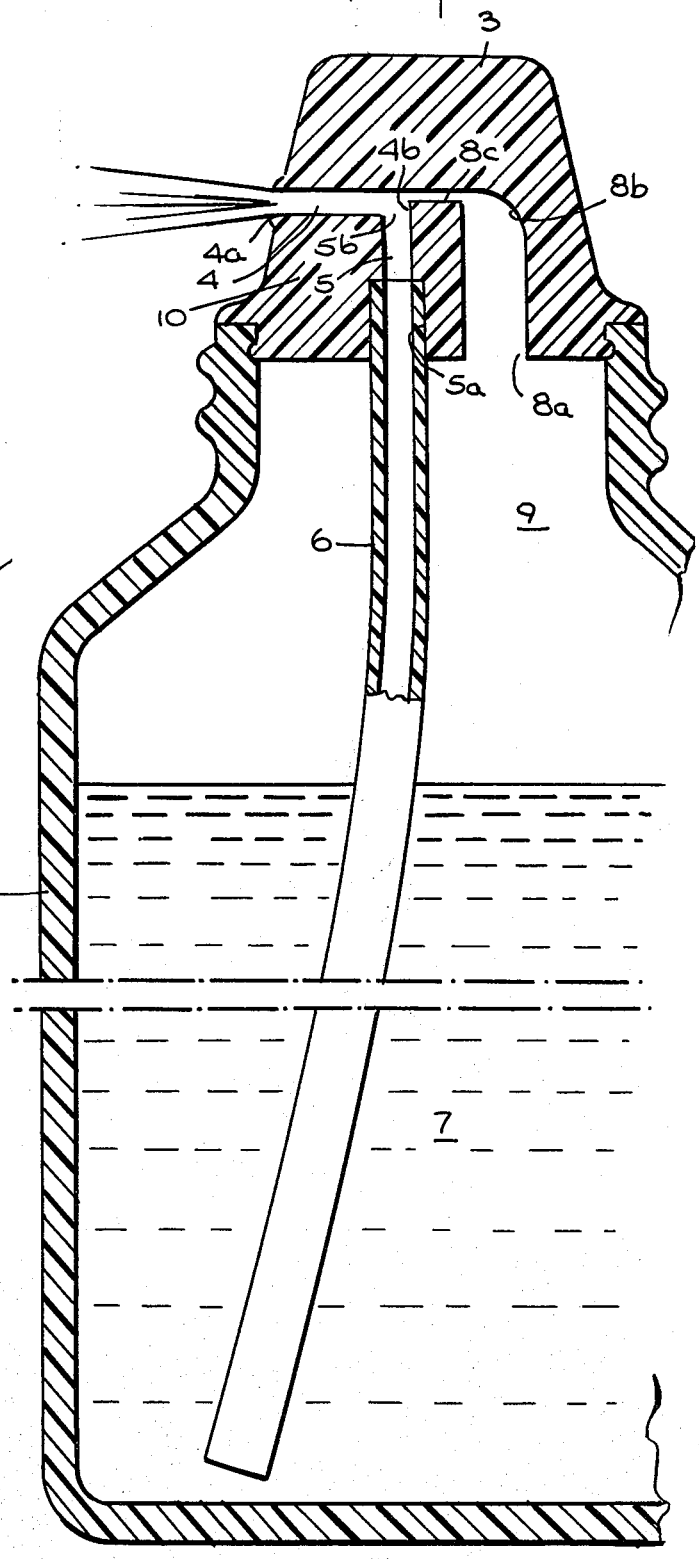
FIG. 2 is a vertical section taken through the bottle and nozzle and showing the nozzles one-piece construction.
Figure 3:
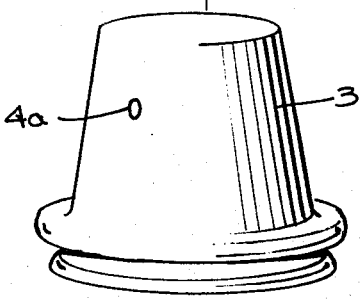
FIG. 3 is a perspective view of the nozzle per se.

The integral construction of the plug or its one-piece character, is shown by FIG. 2. The transverse of horizontal first passage 4 has a front end 4*a* opening through the side of the plug with the opening surrounded by a lip to provide a seal for a possible cap closure (not shown). The longitudinal or vertical second passage 5 has a bottom end 5*a* opening from the plug's bottom and forming a connection for a dip tube 6 which dips into the liquid 7 in the bottle 1. The top end 5*b* of the passage 5 opens into the first passage without any velocity-increasing restriction of any kind, so as to cause a solid column of the liquid 7 to rise with an exposed top surface into the first passage when the bottle is squeezed.

The first passage 4 overlaps the top end of the second passage 5 and has a back end 4*b* adjacently or right behind the second passage's top end. The rising column of liquid rises solidly up into the passage 4 in front of its end 4*b* with the column's top forming more or less of a meniscous depending on the viscosity of the liquid product in the bottle.

The longitudinal or third passage 8 has a bottom end 8*a* opening from the bottom of the plug 3 into the head or air space 9 in the bottle above the liquid product 7. This third passage opens into the first passage's back end 4*b* via a bend 8*b* and a velocity-increasing orifice 8*c* pointing axially forwardly into the first passage 4 towards the latter's front end 4*a* and at a level spaced above the second passage's top end 5*b*. When the bottle is squeezed this orifice 8*c* ejects a high velocity air jet over the top of the column of liquid rising from the second passage 5. This shears off or skims off the very top of the column of liquid so as to produce the desired horizontal spray discharge through the first passage 4 and horizontally from the nozzle or body or plug 3. For this action to be effective the orifice 8*c* must be at a level higher than the top of the passage 5 and preferably as high as is possible or, so that the top of the orifice 8*c* is flush with the top of the passage 4, as illustrated.

Both the passages 5 and 8 can be made with large cross sectional areas. The bend 8*b* of the passage 8 should curve gently and be streamlined.

For installation the plug 3 is shown with a simple end construction of the conventional kind used by some bottle stoppers, keeping in mind that the internal pressure available when squeezing the bottle is quite low. The entire body or plug 3 can be a single injection molding obtained via a one shot injection using core pins for the three passages and the orifice connection 8*c*.

A finer spray may be obtained if a fourth longitudinal or vertical passage 10 is formed with a small cross section so as to receive air through its bottom end when the bottle is squeezed, and eject this air right angularly into a discharge through the transverse or horizontal passage 4. This is a modification that might also be used to reduce the required bottle squeezing force and increase the venting rate because it provides an additional air passage.

FIGS. 4–7 show the same basic components and they are therefore corresponding numeraled but primed for identification. With this modification the front end of the passage 4' is molded with a counterbore 11 of enlarged cross section relative to that of this first passage, and the fourth passage 10', always used in this instance, is positioned so that its top end opens transversely into this counterbore. With this modified basic one part plug, a separate fittment 12 can be provided for insertion in the counterbore 11. This fittment has a nozzle orifice 13 which on the inside of the fittment is surrounded by vanes 14 which curve around the inner end of the nozzle's orifice and have interspaced circumferential ends 14*a*, these vanes having inner or back side edges which contact the shoulder formed by the counterbore 11. The vanes all curve in the same direction with substantially the same radius about the nozzle orifice passage. The outside diameter of the cluster of vanes is less than the inside diameter of the counterbore 11 so that a circumferential space 15 is formed around the group of vanes.

With this simple fittment used, the air forced up through the fourth passage 10' fills the space 15, enters the space between the tips of the vanes, and is imparted a swirling action which mixes at the inlet end of the nozzle orifice 13 with the discharge travelling forwardly through the first passage 4'.

I claim:

1. A spray-dispensing nozzle comprising a one-piece body having a side and a bottom and internally formed with a transverse first passage having a front end opening through said side; a longitudinal second passage having a bottom end opening from said bottom and a top end opening into the first passage without velocity-increasing restrictions so as to cause a solid column of liquid to rise with an exposed top surface in said first passage when the second passage's said bottom end is supplied with a flow of solid liquid, said first passage overlapping said top end of the second passage and having a back end adjacently behind the second passage's said top end, said body having a longitudinal third passage having a bottom end opening from said bottom and adapted to be supplied with a flow of air, said third passage opening into the first passage's said back end via a bend and a velocity-increasing orifice pointing axially forward into said first passage toward the latter's said front end and at a level spaced above the second passage's said top end and adapted to eject a high-velocity air jet which shears off liquid from said top surface of said solid column of liquid, when the bottom end of said third passage is supplied with said flow of air; said body having a longitudinal fourth passage having a bottom end opening from the body's said bottom and a top end opening into said first passage between its said front end and the top end of said second passage, said fourth passage being of small cross-section as compared to that of the other of said passages; and in which the front end of said first passage forms a counterbore of enlarged cross-section relative to that of the first passage and the fourth passage's said top end opens transversely into this counterbore and a fittment having a nozzle orifice is inserted in said recess, said counterbore forming an annular shoulder and said fittment having an inner end formed by vanes which curve around the fittment's said nozzle orifice and having interspaced circumferential ends, said vanes having inner sides substantially contacting said shoulder.

* * * * *